United States Patent [19]

Chang

[11] 4,193,864

[45] Mar. 18, 1980

[54] RESIDUAL OIL DESULFURIZATION IN MULTIPLE ZONES WITHOUT CONCOMMITANT INCREASE IN HYDROGEN CONSUMPTION

[75] Inventor: Clarence D. Chang, Princeton, N.J.

[73] Assignee: Mobil Oil Corporation, New York, N.Y.

[21] Appl. No.: 912,126

[22] Filed: Jun. 2, 1978

Related U.S. Application Data

[63] Continuation of Ser. No. 769,640, Feb. 17, 1977, abandoned.

[51] Int. Cl.[2] ..... C10G 23/02

[52] U.S. Cl. ..... 208/210; 208/214

[58] Field of Search ..... 208/210, 211, 89, 214

[56] References Cited

U.S. PATENT DOCUMENTS

| | | | |
|---|---|---|---|
| 3,732,155 | 5/1973 | Cecil et al. | 208/210 |
| 4,016,069 | 4/1977 | Christman et al. | 208/210 |

*Primary Examiner*—George Crasanakis
*Attorney, Agent, or Firm*—Charles A. Huggett; Raymond W. Barclay; Thomas S. Szatowski

[57] ABSTRACT

A process is provided for the desulfurization of residual oil by (a) separating the residual oil into a first and a second fraction;

(b) reacting the first fraction with hydrogen over a hydrodesulfurization catalyst in a first reaction zone at hydrodesulfurization conditions such that a liquid effluent of lower sulfur content than the residual oil is obtained;

(c) combining the hydrodesulfurization liquid effluent with the second residual oil fraction; and (d) reacting the resultant mixture over a hydrogenation/dehydrogenation catalyst in a second reaction zone at hydrogen transfer conditions.

This process provides for desulfurization of residual oils at lower hydrogen consumptions than conventional processes.

6 Claims, 1 Drawing Figure

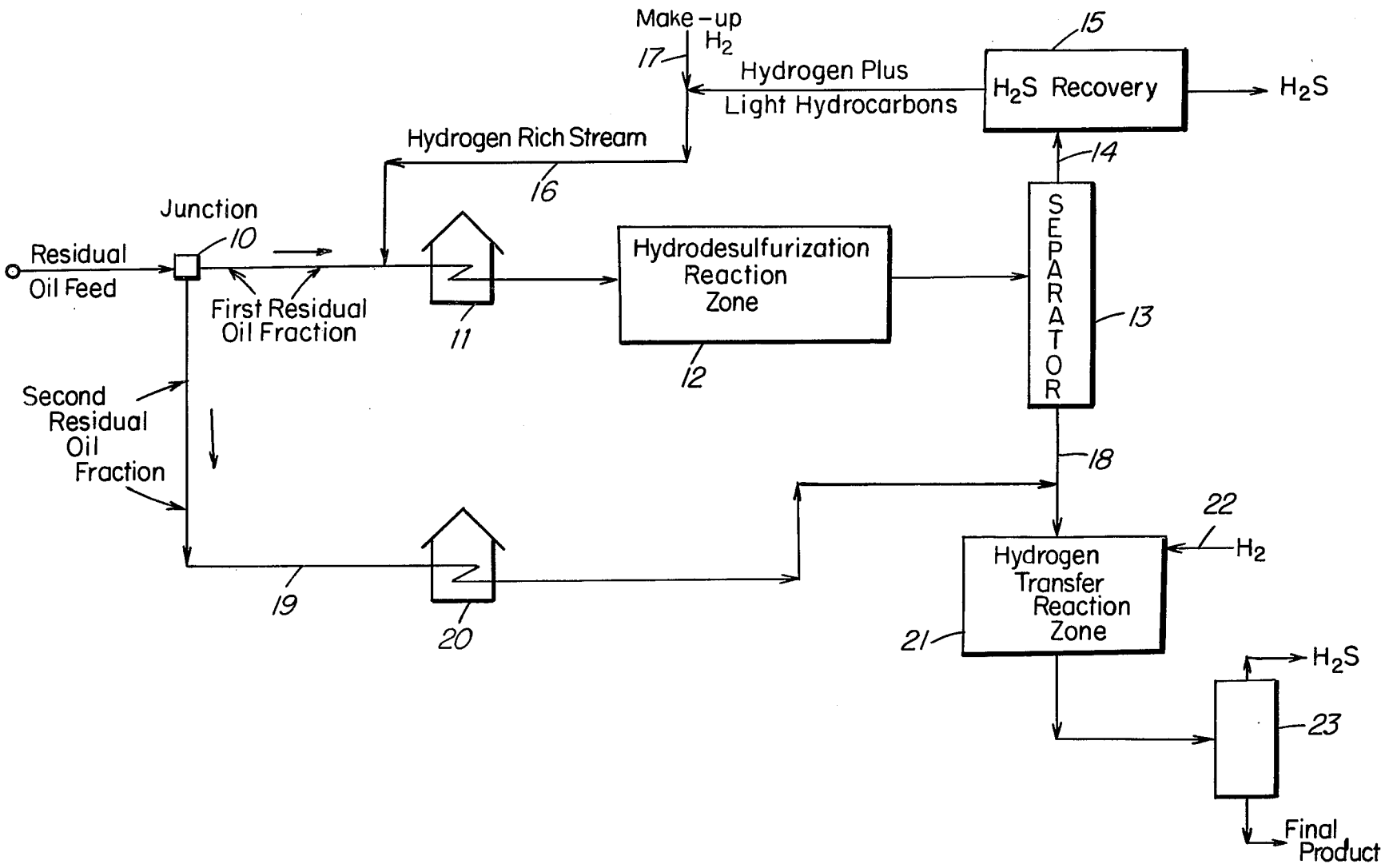
$H_2S$
15
$H_2S$ Recovery
14
SEPARATOR
13
18
22
$H_2$
Hydrogen Transfer Reaction Zone
21
$H_2S$
23
Final Product
Hydrogen Plus Light Hydrocarbons
Make-up $H_2$
17
Hydrogen Rich Stream
16
Hydrodesulfurization Reaction Zone
12
11
20
19
First Residual Oil Fraction
Junction
10
Residual Oil Feed
Second Residual Oil Fraction

RESIDUAL OIL DESULFURIZATION IN MULTIPLE ZONES WITHOUT CONCOMMITANT INCREASE IN HYDROGEN CONSUMPTION

This is a continuation of copending application Ser. No. 769,640, filed Feb. 17, 1977 and now abandoned.

BACKGROUND OF THE INVENTION

1. Field of the Invention

The invention relates to a process for the desulfurization of a residual oil. When compared to a conventional hydrodesulfurization process, the process of this invention provides for the equivalent desulfurization of residual oils at a lower hydrogen consumption.

2. Description of the Prior Art

In the refining of crude petroleum oils the lower boiling constituents of the crude oil are usually separated by atmospheric and/or vacuum distillation. The portions so separated are generally known as residual oils, residuum or black oils and may comprise 2 to 25% or more of the original crude. Often, these residual oils are utilized as fuels, especially in factories, power plants or ships. However, due to the stringent air quality regulations that are in force today, such uses for the residual oils may be diminished unless the high amount of sulfur that is present in these oils can be removed.

Many processes for effecting the removal of sulfur from petroleum hydrocarbons are known in the art. One method is known as autofining and is described in U.S. Pat. No. 2,672,433 of Porter et al. and U.S. Pat. No. 2,719,108 of Porter. Briefly, this method involves deriving sufficient hydrogen by dehydrogenation of the naphthenes contained in a feedstock to enable the organically combined sulfur in the feedstock to be converted to hydrogen sulfide.

Other patents, namely; U.S. Pat. No. 2,706,703 of Porter, U.S. Pat. No. 2,800,431 of Porter et al., U.S. Pat. No. 2,889,272 of Moy et al., U.S. Pat. No. 2,893,953 of Turner et al., U.S. Pat. No. 2,900,331 of Porter et al. and U.S. Pat. No. 3,250,698 of Cuddington et al. provide additional description of the autofining process.

A petroleum stream containing materials such as naphthenes or aromatics, which are capable of accepting or releasing hydrogen, is commonly known as a hydrogen donor diluent. The use of hydrogen donor diluents in the conversion of hydrocarbons is disclosed in U.S. Pat. No. 3,238,188 of Arey et al.

Other patents which describe the use of hydrogen donor diluents in cracking of hydrocarbons include: U.S. Pat. No. 2,873,245 of Thompson et al., U.S. Pat. No. 2,772,221 of Stewart et al., U.S. Pat. No. 3,252,888 of Langer et al., U.S. Pat. No 2,953,513 of Langer and U.S. Pat. No. 3,553,936 of Weisz.

In U.S. Pat. No. 2,703,780 of Voorhies, a process for the removal of sulfur from sulfur-containing compounds by transfer of hydrogen from a hydrogen donor compound in the presence of an activated carbon catalyst is disclosed.

None of these patents describe the novel process of this invention.

Perhaps the most common process for the removal of sulfur from hydrocarbons is the conventional hydrodesulfurization process. Briefly, this process involves passing the feed in admixture with hydrogen over a desulfurization catalyst. Although remarkably effective in the removing of sulfur, the hydrodesulfurization process consumes large amounts of expensive hydrogen in the processing of residual oils, thus adding greatly to the operating costs.

Thus, it would be most desirable to provide a process which would effect the desulfurization of residual oils, but would consume less hydrogen than the present hydrodesulfurization process.

SUMMARY OF THE INVENTION

It has now been found that a split feed process for the desulfurization of a residual oil which comprises:

(a) separating the residual oil into a first and a second fraction;

(b) reacting the first fraction with hydrogen over a hydrodesulfurization catalyst in a first reaction zone at hydrodesulfurization conditions, such that a liquid effluent of lower sulfur content than the residual oil is obtained;

(c) combining the hydrodesulfurization liquid effluent with the second residual oil fraction; and, (d) reacting the resultant mixture over a hydrogenation/dehydrogenation catalyst in a second reaction zone at hydrogen transfer conditions;

will represent a savings in hydrogen consumption at equivalent desulfurization when compared to the conventional hydrodesulfurization process.

The efficacy of the present process in the desulfurization of residual oil at reduced hydrogen consumption will be explained presently. First, considering the conventional hydrodesulfurization process, it is seen that excess hydrogen, i.e., an amount above that necessary to convert the organic sulfur contained in the feed to hydrogen sulfide ($H_2S$), is consumed when aromatics are hydrogenated to naphthenes. Hydrogenation of aromatics to naphthenes is an undesirable side reaction which is inherent in the conventional hydrodesulfurization process. This is illustrated by the following example in which Aramco-Nigerian residua was processed with hydrogen over a catalyst which consisted: of 3.6 weight percent NiO, 14.7 weight percent $MoO_3$ with the remainder being alumina, at 2000 psig pressure, 0.5 LHSV and 750° F. reactor inlet temperature. Table 1 depicts the feed and product compositions:

TABLE 1

| | Conventional Hydrodesulfurization | |
|---|---|---|
| Composition, wt. % | Residual Oil Feed | Hydrodesulfurization Product Oil |
| Sulfur | 2.04 | 0.1 |
| Paraffins | 21.1 | 25.5 |
| Napthenes | 25.1 | 48.0 |
| Aromatics | 53.8 | 26.5 |

From the table, it is evident that approximately 50% of the aromatics present in the feed were converted, mostly to naphthenes, thus consuming expensive hydrogen in this undesirable side reaction.

However, in the process of this invention, the hydrodesulfurization product oil, which contains an increased amount of naphthenes, is now used as a hydrogen donor diluent for the processing of additional residual oil feed at conditions which promote hydrogen transfer. At such conditions, naphthenes will be converted to aromatics and the hydrogen released will be utilized in converting the organic sulfur contained in the additional residual oil feed to hydrogen sulfide. Thus, some of the excess hydrogen consumed in the conventional hydrodesulfurization process step can be recovered.

In this manner, the present process provides that more residual oil feed can be processed without the use of any additional hydrogen, in effect, lowering the hydrogen consumption per barrel of resid processed.

BRIEF DESCRIPTION OF THE DRAWING

The single FIGURE depicts an embodiment of the invention in schematic form.

DESCRIPTION OF PREFERRED EMBODIMENTS

With reference to the drawing, residual oil feed is split into a first and second fraction at junction 10. Residual oil is generally described as those heavy petroleum fractions produced by atmospheric and/or vacuum distillation of crude oils. Since the high sulfur components of the crude oil tend to be concentrated in the higher boiling fractions, residual oil fractions generally contain from about 1 to about 5% by weight of sulfur. The process of the present invention is not limited to use of petroleum oil residua, but other heavy hydrocarbon stocks such as tar sands, bitumen, shale oils and the like may be effectively processed. Accordingly, the residual oil or heavy hydrocarbon stocks contemplated for use herein generally boil above 400° F., preferably above 650° F., and have gravities from about 7°API to about 25°API.

The first residual oil fraction is mixed with a hydrogen-rich stream 16 and the resulting admixture is heated in furnace 11 before being charged to the first hydrodesulfurization reaction zone 12. Reaction zone 12 contains desulfurization catalyst and is operated at conventional hydrodesulfurization conditions, as will be described presently. The reaction zone may include a plurality of catalyst beds with hydrogen rich gas injection between the beds to effect quenching, as is known in the art.

Catalysts which can be used to promote desulfurization reactions generally contain at least one metallic component selected from the Groups VIB and VIII of the Periodic Table deposited on a refractory inorganic oxide support or binder. The preferred metallic component may be an oxide or sulfide of nickel or cobalt, particularly the latter and an oxide or sulfide of molybdenum or tungsten. The Group VIII metal is generally present in amounts from 1–15 percent by weight, while the Group VIB component is present in amounts from 5–25 percent by weight. The refractory inorganic oxide support may comprise alumina, silica, zirconia, magnesia, titania, boria, strontia, hafnia, and mixtures thereof. Particularly preferred are alumina or silica stabilized alumina, with the alumina being of the greater proportion. A typical catalyst consists of 3 percent CoO, 10 percent $MoO_3$, and 5 percent silica with the remainder being alumina. Catalysts are generally presulfided prior to use.

Table 2 lists suitable reaction conditions for the catalytic hydrodesulfurization of residual oils.

TABLE 2

| | Hydrodesulfurization Conditions | |
|---|---|---|
| | General Range | Preferred |
| Pressure, psig | 500–3000 | 1000–2000 |
| Temperature, °F. | 600–1000 | 700–850 |
| Space Velocity LHSV | 0.2–5 | .5–2.0 |
| Hydrogen Rate, SCF/BBL | 1000–20,000 | 5000–10,000 |

The effluent from hydrodesulfurization reaction zone 12 is passed to separator 13. In separator 13, which preferably is a high pressure flash, the effluent from the reaction zone is separated into liquid and gaseous streams. The gaseous stream, which includes $H_2$, $h_2S$ and any light hydrocarbons, goes overhead into line 14. The liquid stream, which contains the desulfurized product, is withdrawn into line 18.

The gaseous stream of line 14 now is passed to hydrogen sulfide recovery system 15, wherein $H_2S$ is removed from the stream preferably by contact with a caustic scrubbing agent such as methylamine. Other hydrogen sulfide recovery systems such as Stretford process may also be used. These are well known in the art. The effluent from the hydrogen sulfide recovery system is a stream which comprises hydrogen and light hydrocarbons. To this stream is added make up $H_2$ from line 17 to form the $H_2$ rich stream 16, previously described.

The hydrodesulfurization liquid effluent in line 18, which was previously described as usable as a hydrogen donor diluent, is conducted to the second or hydrogen transfer reaction zone 21, where it is combined with the second residual oil fraction before being reacted at conditions which promote hydrogen transfer. The second residual fraction in line 19 may be heated in furnace 20 before entering hydrogen transfer reaction zone 21.

It is apparent that if the two streams were simply mixed, the sulfur level of the residual oil stream would be lowered due to dilution by the hydrodesulfurized product. This simple mixing, however, makes no use of the available hydrogen in the naphthenes of the hydrodesulfurized product. Therefore, it is important that the two streams be contacted under hydrogen transfer conditions.

A catalyst which promotes hydrogenation/dehydrogenation reactions is present in reaction zone 21. Suitable hydrogenation/dehydrogenation catalysts generally contain at least one metallic component selected from the Groups VIB and VIII of the Periodic Table, deposited on an acidic support or binder. Oxides or sulfides of the metallic components may also be employed. The Group VIII metallic component is generally present in amounts from 1–15 percent by weight, while the Group VIB component is generally present in amounts from 5–25 percent by weight. Particularly contemplated are combinations of the metallic component such as cobalt/molybdenum and nickel/molybdenum. Suitable acidic support materials include the refractory inorganic oxides such as alumina, silica, zirconia, magnesia, titania, boria, strontia, hafnia, and mixtures thereof. Preferred are alumina or silica stabilized alumina, with the alumina being of the greater proportion. The group of crystalline aluminosilicate materials known as zeolites are also contemplated as suitable for use as the catalyst support. Non-limiting examples of the zeolite materials include such synthetic zeolites as A, B, L, T, X, Y, ZK-4, ZK-5, ZSM-4, ZSM-5 and others, and the naturally occurring zeolites levynite, dachiarite, erionite, faujasite, analcite, paulingite, noselite, phillipsite, chabazite, leucite, mordenite, ferrierite and others.

Table 3 lists suitable conditions for the promotion of the hydrogen transfer reaction.

TABLE 3

| Hydrogen Transfer Conditions | General Range | Preferred |
|---|---|---|
| Pressure, psig | 500–3000 | 700–2000 |
| Temperature, °F. | 700–1200 | 850–1000 |
| Space Velocity, LHSV | 0.2–5 | 0.2–1 |

The reaction is carried out under a pressure sufficient to maintain the combined feedstock, i.e. residual oil feed from line 19 and hydrodesulfurized product from line 18, substantially in the liquid phase. In this manner, it is possible to dehydrogenate the naphthenes contained in the combined feedstock and to utilize the hydrogen so released in converting the organic sulfur to $H_2S$. The small amount of hydrogen present in the reaction zone is sufficient to enable a substantial hydrogen pressure to be built up in the reactor enabling hydrogenation of the sulfur-containing molecules to be effected. However, to maintain pressure, it may be desirable to add small amounts of additional hydrogen to reaction zone 21 via line 22 if conditions warrant. The effluent from reaction zone 21 is conducted to separator 23, where $H_2S$, as well as any $H_2$ and light hydrocarbons which may be formed, are separated from the final product.

It is the desired sulfur level of the final product which determines the relative amounts of desulfurized product in line 18 and additional residual oil feed in line 19 which are combined prior to reaction under hydrogen transfer conditions in reaction zone 21.

For most applications, in which the sulfur level of the final product is low, i.e., about 0.5% by weight or lower is contemplated that the streams are combined in the following proportions: from about 0.5 to about 4 BBL of hydrodesulfurized product per BBL fresh residual oil, with about 0.7 to 3 BBL/BBL being preferred.

Therefore, it is noted from the foregoing that the first residual oil fraction, which is separated at junction 10, generally amounts to from about 33 to about 80%, of the original residual feed, and is preferably about 40 to about 75%.

In the typical modern refinery, $H_2S$ gas which eminates from both $H_2S$ recovery unit 15 and separator 23, is usually sent to sulfur recovery units (not shown), where the $H_2S$ is converted to elemental sulfur via known processes, such as the Claus Process, thus preventing discharge of this dangerous gas to the atmosphere.

I claim:

1. A process for effecting the desulfurization of increased amounts of a residual oil, which oil boils above about 650° F., without a concomitant increase in hydrogen consumption, which comprises:

(a) hydrodesulfurizing a residual oil feed by reacting said feed with hydrogen over a hydrodesulfurization catalyst in a first reaction zone at hydrodesulfurization conditions of from about 500 to about 3000 psig pressure, about 600 to about 1000° F. temperature, about 0.2 to about 5 LHSV and about 1,000 to about 20,000 SCF/bbl. hydrogen rate, whereby a portion of the aromatics contained in said feed are converted to naphthenes and a portion of the organically combined sulfur contained in said feed is converted to hydrogen sulfide, thereby obtaining a liquid effluent having a lower sulfur content and a higher naphthene content than said residual oil feed; and (b) desulfurizing an additional amount of said residual oil by combining said additional amount with the effluent of step (a) in an amount of from about 0.5 to about 4 bbl. of effluent of step (a) per bbl. of additional residue oil feed and reacting the resultant mixture in a second reaction zone over a catalyst comprising at least one metallic component selected from Groups VIB and VIII of the Periodic Table deposited on an acidic support selected from the group consisting of refractory inorganic oxides, crystalline aluminosilicate zeolites and combinations thereof, at conditions such that naphthenes contained in the mixture are dehydrogenated and the hydrogen so released is utilized to convert organically combined sulfur contained in said mixture to hydrogen sulfide, wherein said conditions comprise about 500 to about 3,000 psig pressure, about 700 to about 1200° F. temperature and about 0.2 to about 5 LHSV and wherein the effluent of step (b) has the same sulfur level as the effluent of step (a).

2. The process of claim 1 wherein said hydrodesulfurization catalyst comprises at least one metallic component selected from the Group VIB andd VIII of the Periodic Table deposited on a refractory inorganic oxide support.

3. The process of claim 1 wherein said residual oil has a gravity from about 7°API to about 25°API.

4. The process of claim 2 wherein said hydrodesulfurization catalyst comprises NiO and $MoO_3$ deposited on an alumina support.

5. The process of claim 1 wherein said residual oil contains from about 1 to about 5% by weight of sulfur.

6. The process of claim 1 wherein said Group VIB metallic ccomponent is present in an amount from about 5 to about 25% by weight and said Group VIII metallic component is present in an amount from about 1 to about 15% by weight of the second reaction catalyst.

* * * * *